US006758626B1

(12) United States Patent
Tseng

(10) Patent No.: US 6,758,626 B1
(45) Date of Patent: Jul. 6, 2004

(54) CONNECTING DEVICE OF A CEILING FAN FOR CONNECTING A BLADE TO A BRACKET

(76) Inventor: Min-Chi Tseng, No. 18, Chen Hsing Tung Street, Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 10/338,864

(22) Filed: Jan. 9, 2003

(51) Int. Cl.[7] ..... F04D 29/34

(52) U.S. Cl. ..... 403/408.1; 403/13; 403/14; 403/348; 416/210 R

(58) Field of Search ..... 416/210 R; 24/DIG. 54, 24/DIG. 56, DIG. 57, DIG. 59; 403/13, 14, 353, 381, 408.1, 348

(56) References Cited

U.S. PATENT DOCUMENTS

| | | | | | |
|---|---|---|---|---|---|
| 289,991 | A | * | 12/1883 | Curtes | 24/DIG. 57 |
| 838,995 | A | * | 12/1906 | Hopkins | 24/DIG. 57 |
| 1,104,204 | A | * | 7/1914 | MacCormack | 24/DIG. 57 |
| 1,190,852 | A | * | 7/1916 | Bishop | 24/DIG. 57 |
| 1,198,661 | A | * | 9/1916 | Recker | 24/DIG. 54 |
| 1,201,682 | A | * | 10/1916 | Bourque | 24/DIG. 57 |
| 1,298,251 | A | * | 3/1919 | Pehel | 24/DIG. 59 |
| 3,514,820 | A | * | 6/1970 | Rogg | 24/DIG. 58 |
| 3,693,220 | A | * | 9/1972 | Pabich et al. | 24/DIG. 54 |
| 3,986,780 | A | * | 10/1976 | Nivet | 403/353 |
| 5,593,265 | A | * | 1/1997 | Kizer | 403/348 |
| 6,371,729 | B1 | * | 4/2002 | Tseng | 416/210 R |
| 6,662,373 | B2 | * | 12/2003 | Frank | 24/DIG. 54 |

* cited by examiner

*Primary Examiner*—Anthony Knight
*Assistant Examiner*—Ernesto Garcia
(74) *Attorney, Agent, or Firm*—Rosenberg, Klein & Lee

(57) ABSTRACT

A connecting device of a ceiling fan includes a base plate securely attached to a connecting portion of a bracket of the ceiling. An oval connecting block is selectively attached to the base plate by a fixing member and received in the blade of the ceiling fan. The oval connecting block has an axis parallel to that of the blade. The oval connecting block includes two opposite ends each having a knob laterally extending from the oval connecting block. A press plate is rotatably mounted on a top of the oval connecting block. The press plate having two opposite ends each bent to abut a top surface of the blade. The knob abuts a bottom surface of the blade and the press plate abuts the top surface of the blade so that the blade is clamped between the knob and the press plate.

3 Claims, 8 Drawing Sheets

CONNECTING DEVICE OF A CEILING FAN FOR CONNECTING A BLADE TO A BRACKET

BACKGROUND OF THE INVENTION

1. Field of the Invention

The present invention relates to a connecting device, and more particularly to a connecting device of a ceiling fan for connecting a blade to a bracket.

2. Description of Related Art

Generally speaking, a ceiling fan usually includes at least three blades each radially mounted to a bracket that is connected to a motor of the ceiling fan. For reducing the volume of the ceiling during transporting and an easy assemble to the user, a connecting device is provided to connect the blade and the bracket for easily assembling and detaching.

A conventional connecting device of a ceiling fan in accordance with the prior art shown in FIG. 7 comprises a connector (52) rotatably mounted on a connecting portion (51) of a bracket (5) of the ceiling fan and having multiple wings (not numbered) radially extending from a top of the connector (52). The bracket (5) is radially mounted to a motor of the ceiling fan. Multiple stubs (53) extend from the connecting portion (51) around the connector (52). Each blade (6) of the ceiling fan has a corridor (61) defined therein to allow the connector (52) extending through the blade and multiple through holes (62) each defined to align with a corresponding one of the stubs (53) to allow the stubs (53) extending through the blade (6) after assembling the blade (6) on the bracket (5). The corridor (61) has a shape corresponding to that of the connector (52) such that to rotate the connector (52) can secure the blade (6) on the bracket (5) after the connector (52) extending through the blade (6) and the stubs (53) received in the through hole (62) in the blade (6).

With reference to FIG. 8, it shows another conventional connecting type of a ceiling between the bracket (7) and the blade (8). The bracket (7) includes a connecting portion (71) formed on a free end of the bracket (7) and multiple stubs (72) extending from the connecting portion (71) toward the blade (8). Each stub (72) has a slender plate (73) rotatably mounted on a free end of the stub (72). The blade (8) has multiple through holes (81) defined in one end thereof. Each through hole (81) has a shape corresponding to that of the slender pate (73) such that to rotate the slender plate (73) can secured the blade (8) on the bracket (7) after the slender (73) pass through the through hole (81) in the blade (8).

However, the two conventional connecting types between the blade and the bracket of a ceiling fan have the same disadvantages as follow. The stubs of the above embodiment are column such the stub contact with the inner periphery of the through hole as a line. Consequently, the blade cannot be securely connected to the bracket.

The present invention has arisen to mitigate and/or obviate the disadvantages of the conventional

SUMMARY OF THE INVENTION

The main objective of the present invention is to provide an improved a connecting device of a ceiling fan for connecting a blade to a bracket.

To achieve the objective, the connecting device in accordance with the present invention comprises a base plate securely attached to a connecting portion of a bracket of the ceiling. An oval connecting block is selectively attached to the base plate by a fixing member and received in the blade of the ceiling fan. The oval connecting block has an axis parallel to that of the blade of the ceiling fan. The oval connecting block includes two opposite ends each having a knob laterally extending from the oval connecting block. A press plate is rotatably mounted on a top of the oval connecting block. The press plate having two opposite ends each bent to abut a top surface of the blade of the ceiling fan. The knob abuts a bottom surface of the blade and the press plate abuts the top surface of the blade so that the blade is clamped between the knob and the press plate.

Further benefits and advantages of the present invention will become apparent after a careful reading of the detailed description with appropriate reference to the accompanying drawings.

DETAILED DESCRIPTION OF THE INVENTION

Figure 1:
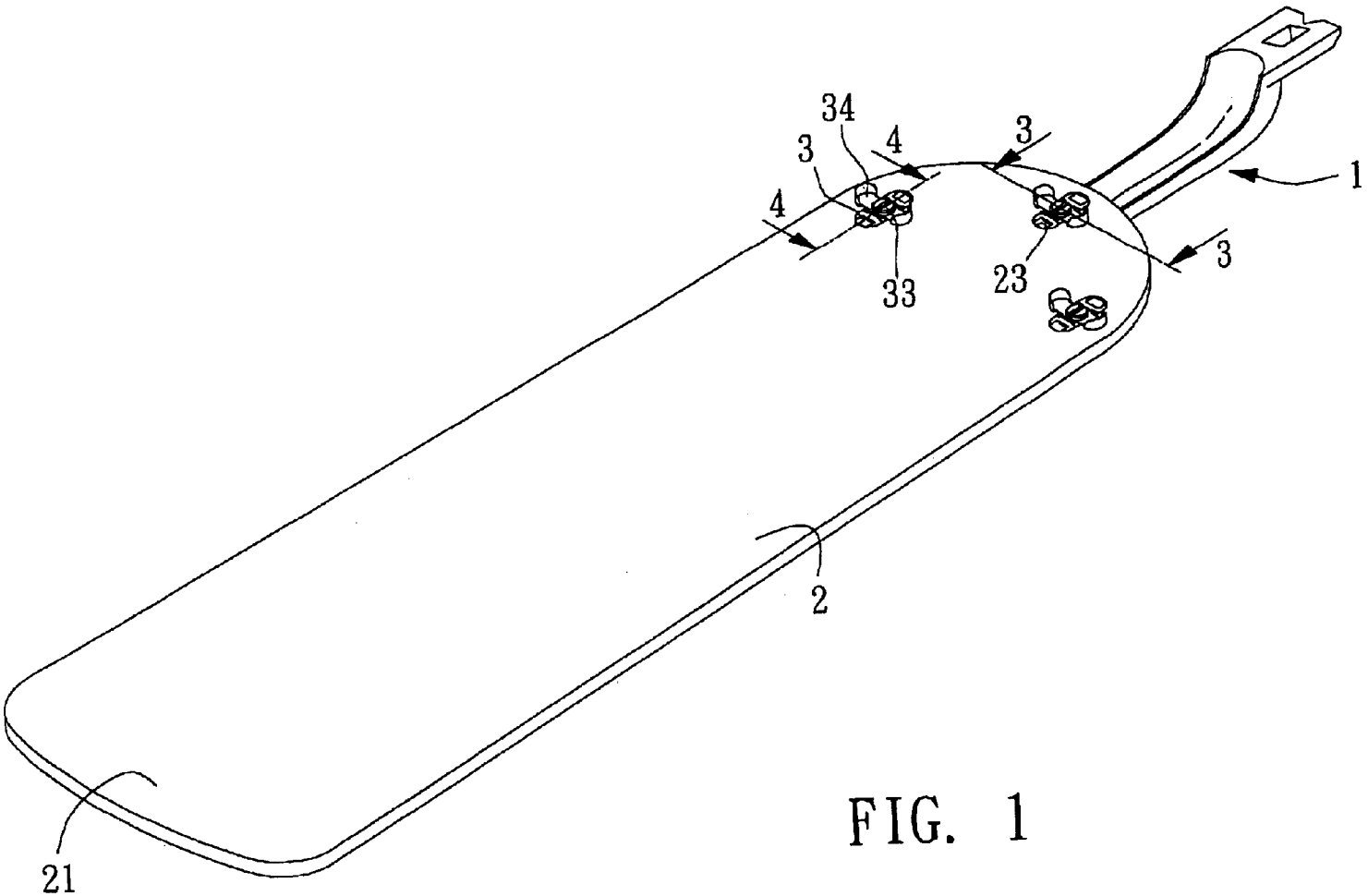
FIG. 1 is a perspective schematic view of a connecting device of a ceiling fan for connecting a blade and a bracket in accordance with the present invention.
Figure 2:
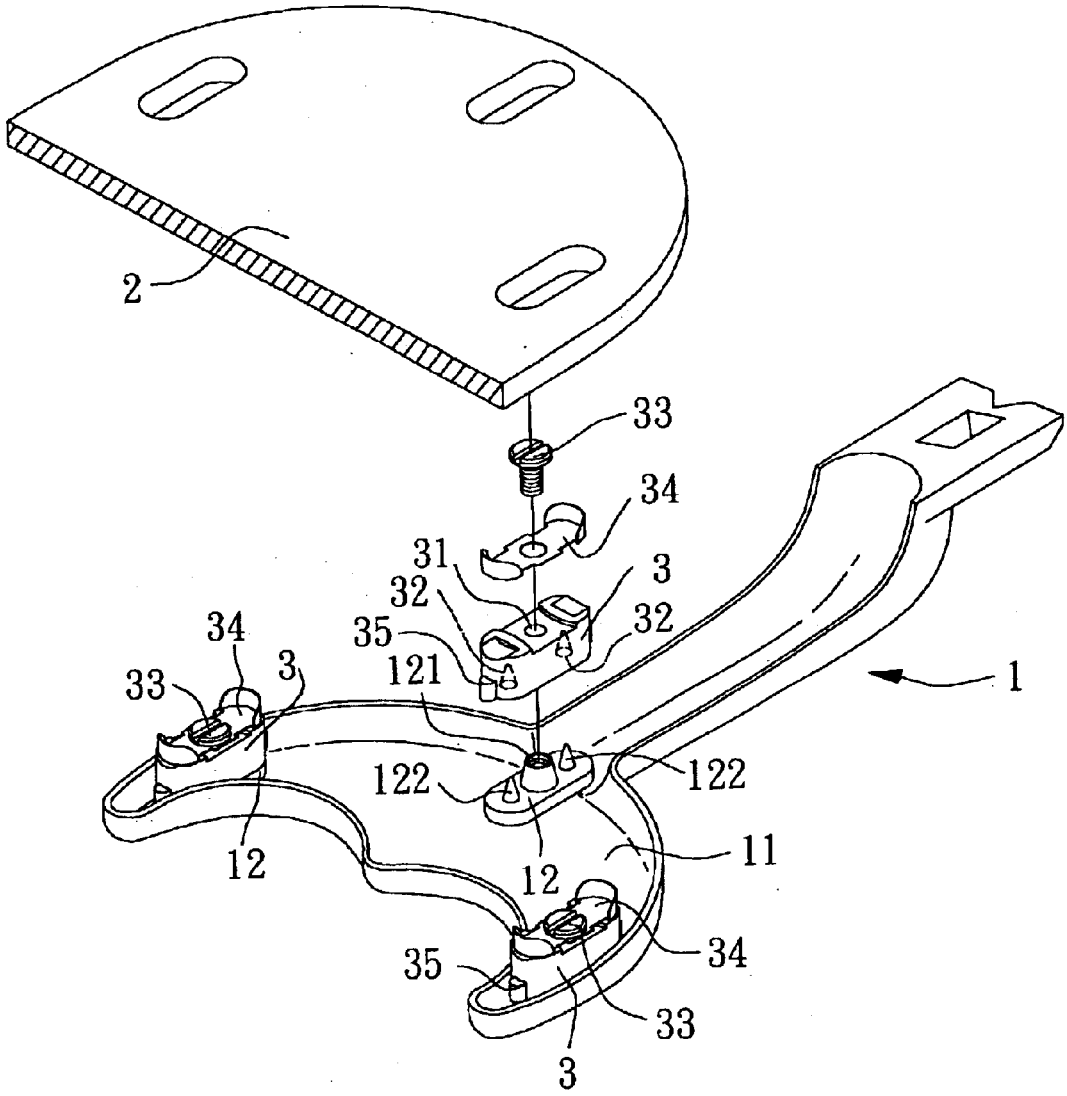
FIG. 2 is an exploded perspective view of the connecting device in FIG. 1.
Figure 3:
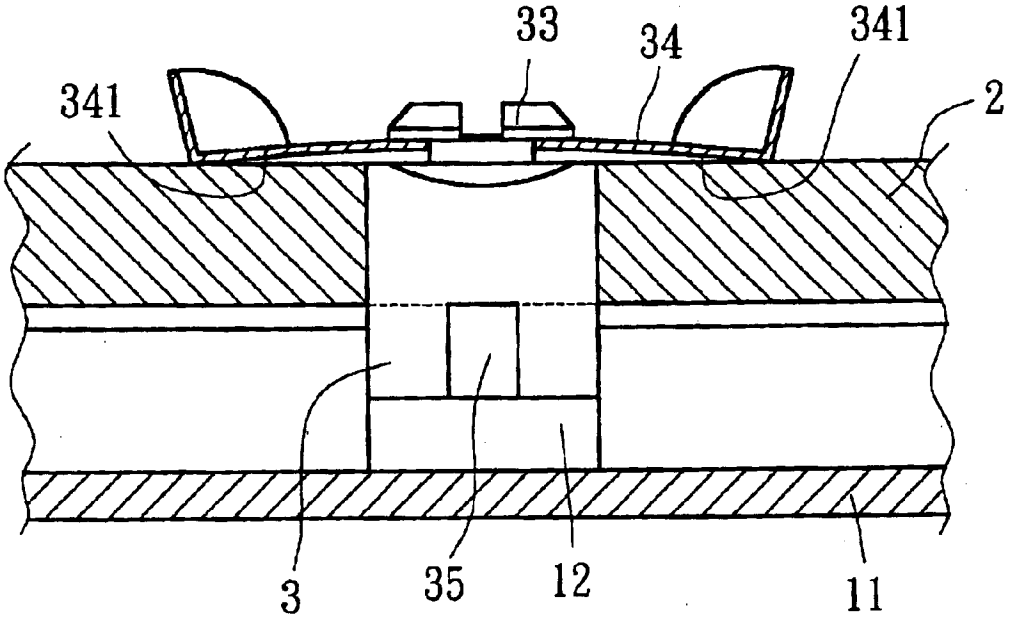
FIG. 3 is a front cross-sectional view of the connecting device in FIG. 1 along line 3—3.
Figure 4:
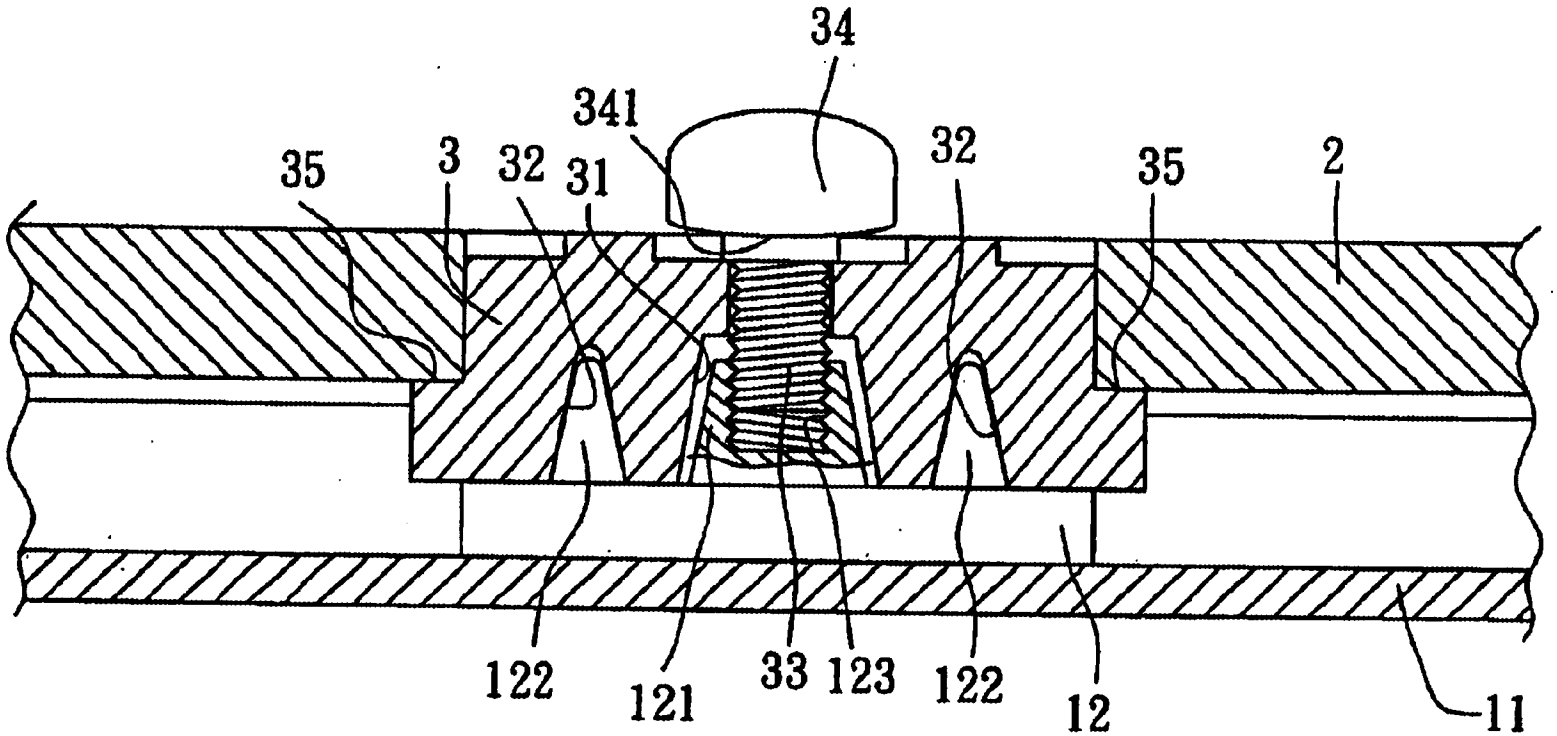
FIG. 4 is a side cross sectional view of the connecting device in FIG. 1 along line 4—4.

Referring to the drawings and initially to FIGS. 1–4, a connecting device of a ceiling fan in accordance with the present invention comprises base plate (12) adapted to be attached to a connecting portion of the bracket (1), a connecting block (3) secured on the base plate (12), a press plate (34) rotatably mounted on the connecting block (3) and a fixing member (33) extending through the press plate (34), the connecting block (3) and mounted to the base plate (12) to hold the connecting block (3) and the press plate (34) in place.

The base plate (12) includes two opposite ends each having a stub (122) upward extending from the base plate (12) and protrusion (121) extending from the base plate (12) between the two stubs (122). In the preferred embodiment of the present invention, the stubs (122) and the protrusion (121) are arranged to be cone-shaped. The protrusion (121) has a threaded hole (123) longitudinally and downward defined in the protrusion (121).

Figure 6:
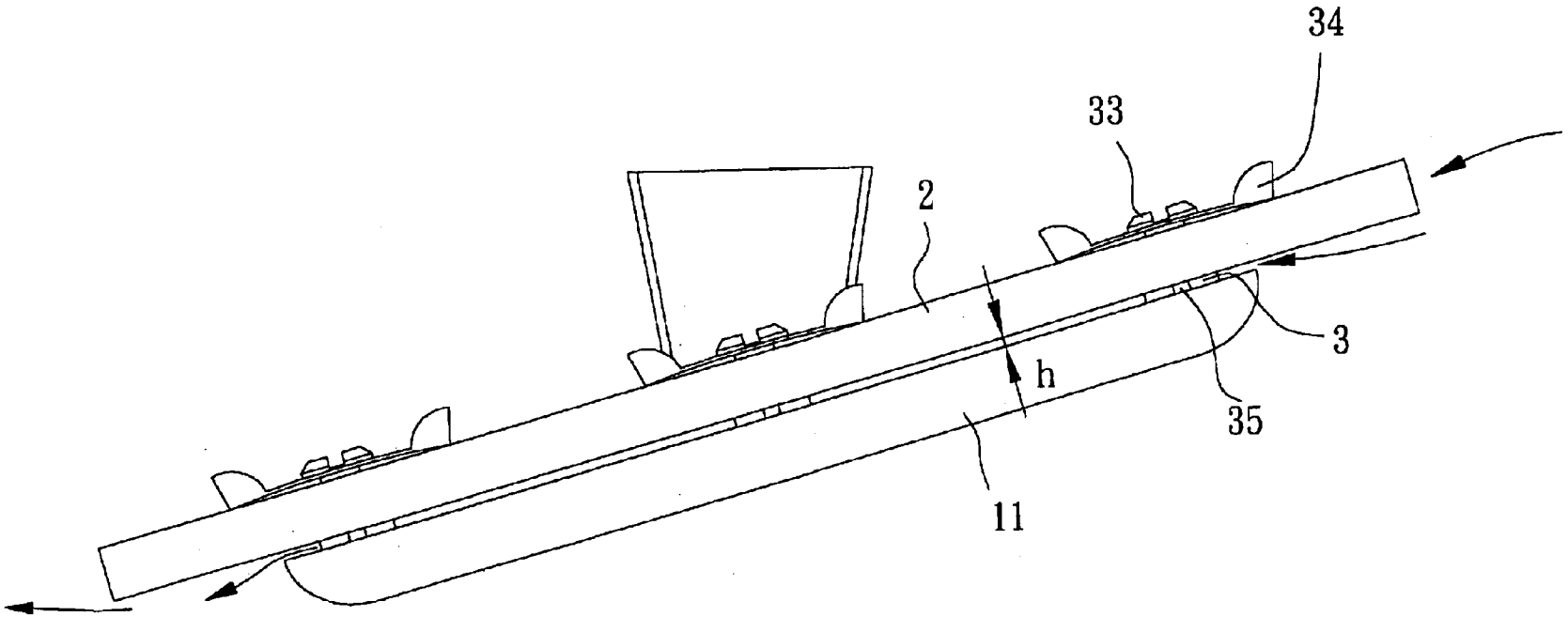
FIG. 6 is a front operational plan view of the connecting device in FIG. 1.
Figure 7:
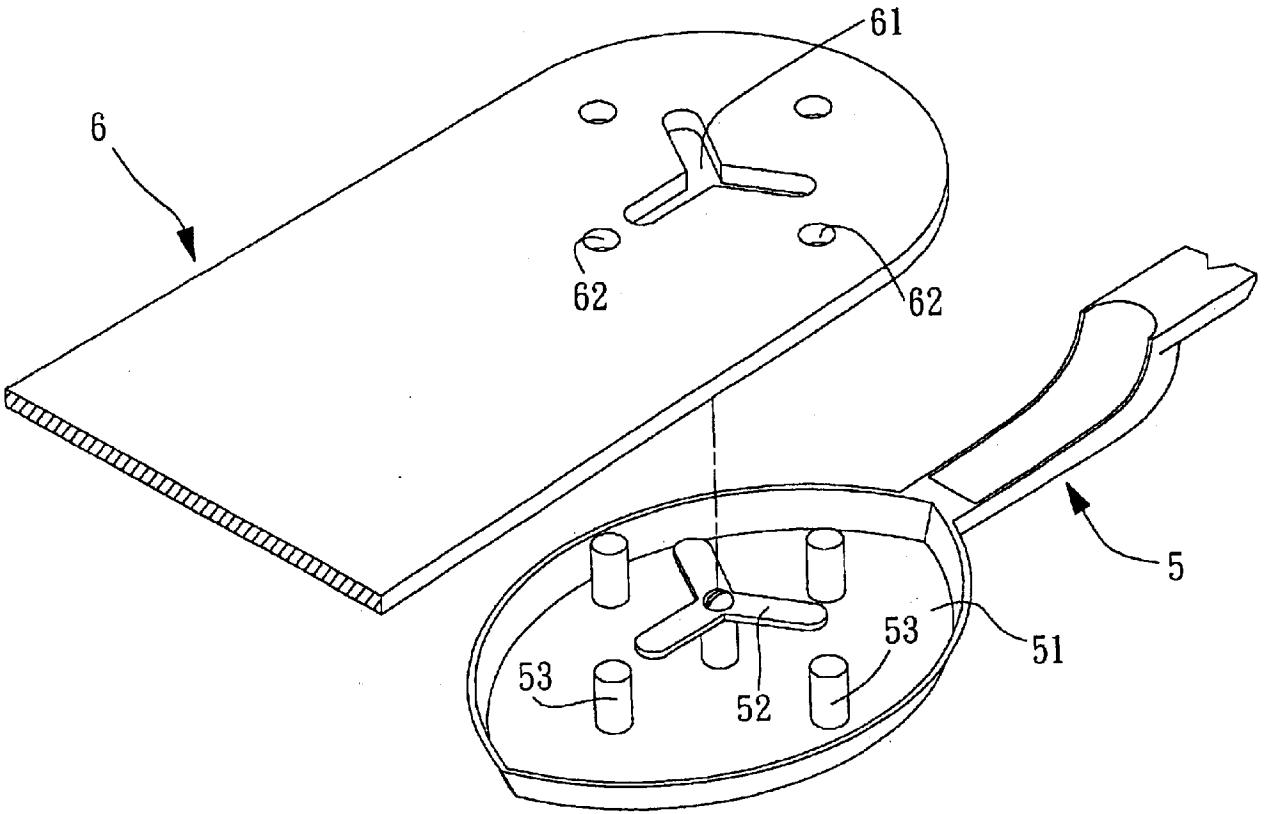
FIG. 7 PRIOR ART
FIG. 7 is a perspective view of a conventional connecting device of a ceiling fan in accordance with the prior art.
Figure 8:
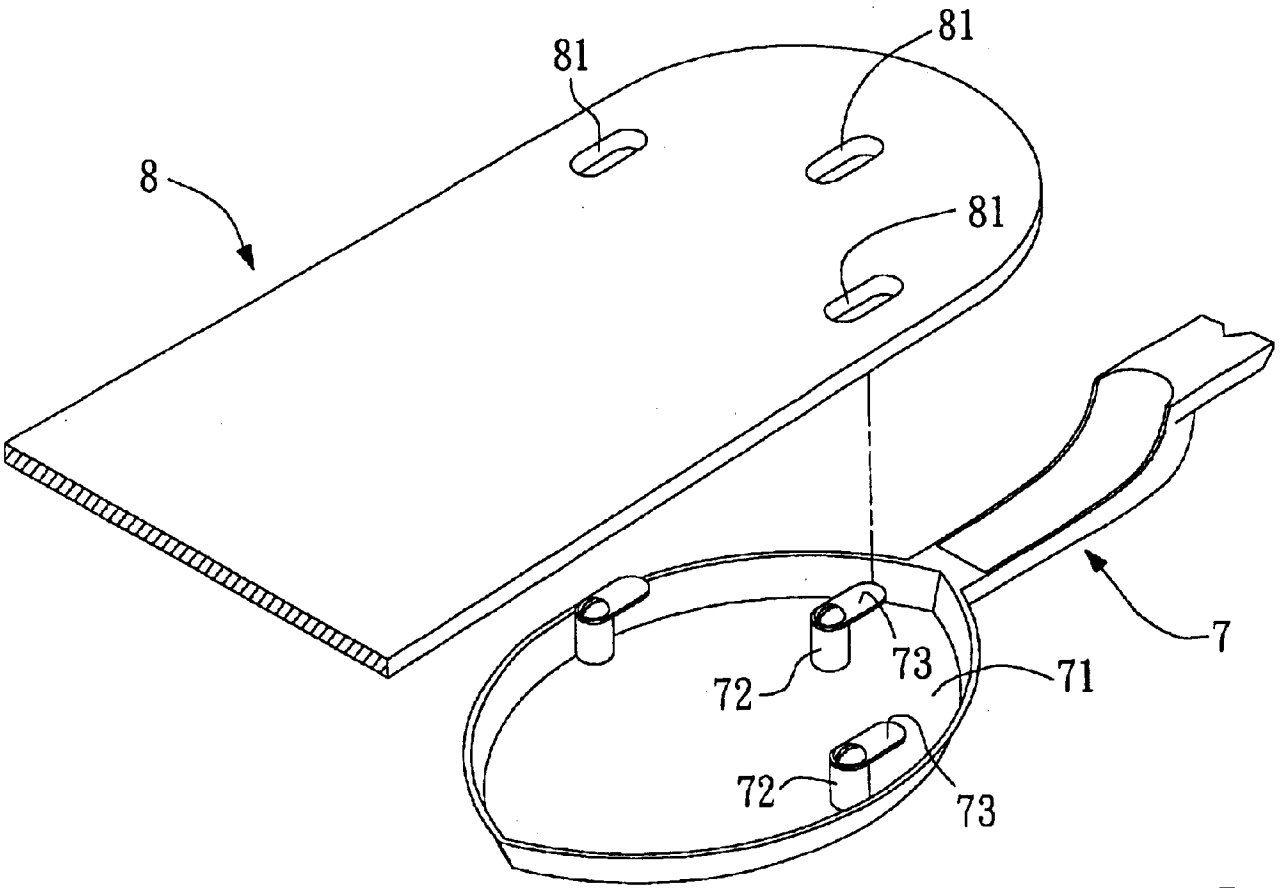
FIG. 8 PRIOR ART
FIG. 8 is a perspective view of another conventional connecting device of a ceiling fan in accordance with the prior art.

The connecting block (3) has a through hole (31) defined therein and aligning with the threaded hole (123) in the protrusion (121). The connecting block (3) is oval and includes two holes (32) defined in a bottom of the connecting block (3) and receiving a corresponding one of the stubs (122) of the base plate (21). Each hole (32) in the connecting block (3) has a shape corresponding to the stub (122) of the base plate (12). The connecting block (3) has two opposite ends each having a knob (35) laterally extending from the connecting block (3) such that a gap (h) is formed between the blade (2) and the bracket (1), as shown in FIG. 6. The press plate (34) is rotatably mounted on a top of the connecting block (3). In the preferred embodiment of the present invention, a bolt (33) extends through the press plate (34) and is screwed into the threaded hole (123) in the protrusion (12) to hold the press plate (34) in place. The press plate (34) has two opposite ends (341) bent to against the blade (2).

For assembling the blade and the bracket of the ceiling fan, there are multiple connecting devices of the present invention are attached to the connecting portion (11) of the bracket (1). The connecting block (3) is partially received in the blade (2) and the press plate (34) passes through the blade (2). Then, the user only needs to turn the press plate (34) to against with the top surface of the blade for connecting the blade to the bracket (1) due to an elasticity of the bent press plate (34).

Figure 5:
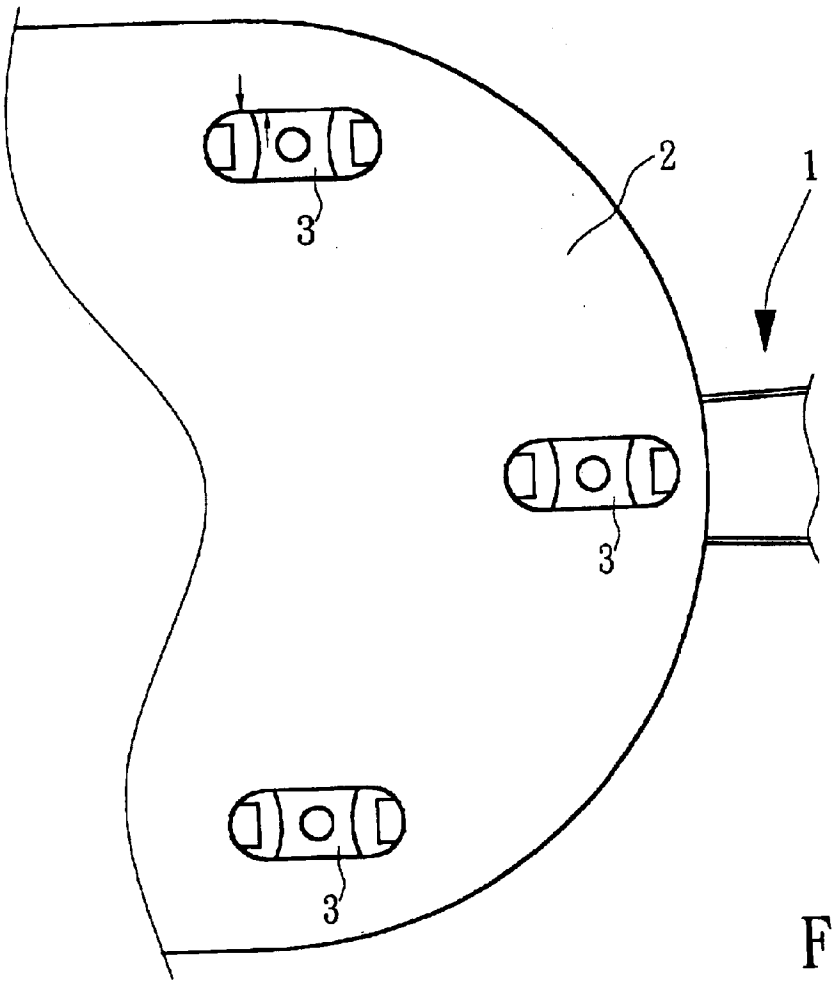
FIG. 5 is a top plan view of the connecting device in FIG. 1.

With reference to FIG. 5, the connecting block (3) of the present invention is oval and as an axis parallel to the blade (2) of the ceiling fan so that there is a contacting area between the connecting device and the blade (2) greater than that between the conventional connecting device and the blade.

With reference to FIG. 6, the protrusions (121) abut a bottom of the blade (2) such that a gap (h) is formed between the blade (2) and the bracket (1). Consequently, the air current passes through the gap (h) when the ceiling fan runs that can prevent a buzz caused by the running ceiling fan.

Although the invention has been explained in relation to its preferred embodiment, it is to be understood that many other possible modifications and variations can be made without departing from the spirit and scope of the invention as hereinafter claimed.

What is claimed is:

1. A connecting device of a ceiling fan for connecting a blade to a bracket, comprising:

a base plate adapted to be securely attached to a connecting portion of a bracket of the ceiling fan an oval connecting block selectively attached to the base plate by a fixing member and adapted to be received in the blade of the ceiling fan, the oval connecting block having an axis adapted to be parallel to that of the blade of the ceiling fan, the oval connecting block including opposite ends each having a knob laterally extending from the oval connecting block; and a press plate rotatably mounted on a top of the oval connecting block, the press plate having two opposite ends each bent to be adapted to abut a top surface of the blade of the ceiling fan;

whereby each knob is adapted to abut a bottom surface of the blade and the press plate is adapted to abut the top surface of the blade so that the blade is clamped between the knobs and the press plate.

2. The connecting device as claimed in claim 1, wherein the base plate comprises two opposite ends each having a cone-shaped stub extending from the base plate and a protrusion extending from the base plate between the two cone-shaped stubs, and the oval connecting block has a through hole defined to receive the protrusion of the base plate, the fixing member extending through the press plate into the through hole in the oval connecting block and partially securely in the protrusion of the base plate.

3. The connecting device as claimed in claim 2, wherein the base plate comprises a threaded hole defined in the protrusion and the fixing member is a bolt that is screwed into the threaded hole in the protrusion of the base plate to hold the oval connecting block and the press plate in place, and adapted for assembling the blade on the bracket of the ceiling fan.

* * * * *